US011308840B2

(12) United States Patent
Choi et al.

(10) Patent No.: US 11,308,840 B2
(45) Date of Patent: Apr. 19, 2022

(54) DISPLAY DEVICE, TIMING CONTROLLER AND SOURCE DRIVER

(71) Applicant: SILICON WORKS CO., LTD., Daejeon (KR)

(72) Inventors: Jung Min Choi, Daejeon (KR); Jong Min Park, Daejeon (KR); Woong Jin Oh, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/100,017

(22) Filed: Nov. 20, 2020

(65) Prior Publication Data

US 2021/0174722 A1 Jun. 10, 2021

(30) Foreign Application Priority Data

Dec. 6, 2019 (KR) ..... 10-2019-0161145

(51) Int. Cl.
*G09G 3/20* (2006.01)

(52) U.S. Cl.
CPC ..... *G09G 3/20* (2013.01); *G09G 2310/0275* (2013.01); *G09G 2310/0291* (2013.01); *G09G 2330/021* (2013.01)

(58) Field of Classification Search
CPC ..... G09G 2320/103; G09G 3/3614; G09G 2340/16; G09G 2370/08; G09G 2320/0295; G09G 2310/0291; G09G 2310/0251; G06F 3/147
See application file for complete search history.

(56) References Cited

U.S. PATENT DOCUMENTS

2007/0159439 A1 7/2007 Park
2015/0103065 A1* 4/2015 Kim ..... G09G 3/3688 345/212
2016/0104445 A1* 4/2016 Hwang ..... G09G 3/3648 345/212
2016/0140892 A1 5/2016 Park et al.

FOREIGN PATENT DOCUMENTS

KR 10-2016-0057571 A 5/2016
KR 10-2016-0069921 A 6/2016
KR 10-1865849 B1 7/2018
KR 10-2019-0015095 A 2/2019
KR 2019-0017603 A 2/2019

* cited by examiner

*Primary Examiner* — Gerald Johnson
(74) *Attorney, Agent, or Firm* — Fenwick & West LLP

(57) ABSTRACT

The present disclosure relates to a technology for a low power operation of a display device. The present disclosure allows reducing power consumption by supplying image data of a pixel of a preceding line again for a pixel of a current line without transmitting new image data when image data are repeated in units of pixels.

15 Claims, 8 Drawing Sheets

| R bit | Item | Description | Power |
|---|---|---|---|
| 1 | TX | No transaction | TCON Power low |
| | 2nd latch | Repeat | |
| | Bias | Bias setting | SDIC power low |

DISPLAY DEVICE, TIMING CONTROLLER AND SOURCE DRIVER

CROSS REFERENCE TO RELATED APPLICATION

This application claims priority from Republic of Korea Patent Application No. 10-2019-0161145, filed on Dec. 6, 2019, which is hereby incorporated by reference in its entirety.

BACKGROUND

1. Field of Technology

The present embodiment relates to a technology for implementing low power of a display device.

2. Description of the Prior Art

A display device may include a panel, a source driver configured to operate a panel, and a timing controller configured to control the operation of the source driver. The panel includes multiple pixels that are arranged parallel to each other in the horizontal direction and the vertical direction and form rows and columns, wherein the multiple arranged pixels are positioned in the panel in the form of a matrix. A row formed when the multiple pixels are arranged in the horizontal direction is also called a line.

The source driver may simultaneously operate multiple pixels which are present in one line. The multiple pixels, which are present in one line, may receive an image signal from the source driver. The multiple pixels may display an image according to the image signal.

The timing controller may transmit control data and image data to the source driver. The timing controller may control, through the control data, the timing at which the source driver operates the panel. The source driver may receive the image data, may generate an image signal corresponding to the image data, and may operate the panel based on the image signal.

Transmission of image data from the timing controller to the panel occurs even when image data of a pixel of a preceding line is identical to image data of a pixel of a current line, which is positioned in the same channel. Even though two types of image data are identical to each other and thus there is no difference therebetween, the same image data are repeatedly transmitted. However, the transmission of the same image data may cause unnecessary transaction, and thus may increase the electromagnetic interference (EMI) and power consumption of a display device.

SUMMARY

An aspect of the present embodiment is to provide a technology for, when image data are repeated in units of pixels, supplying image data of a pixel of a preceding line again for a pixel of a current line without transmitting new image data.

Another aspect of the present embodiment is to provide a technology for, when image data are repeated in units of pixels, adjusting a bias current of a buffer configured to output a data voltage.

Another aspect of the present embodiment is to provide a technology for performing charge sharing.

To this end, in an aspect, the present disclosure provides a timing controller comprising: a controlling unit configured to compare first image data of a pixel of a current line with second image data of a pixel of a preceding line, determine whether to include the first image data in a data packet, based on a result of the comparison, and insert a comparative indicator indicating the result of the comparison into the data packet; and a transmitting unit configured to transmit the data packet to a source driver.

In the timing controller, the data packet may comprise N (N being a natural number equal to or greater than 2) unit interfaces (UIs), a first UI and a Nth UI may be used to extract a clock, and the comparative indicator may be inserted into a second UI or a (N−1)th UI.

In the timing controller, the data packet may comprise N (N being a natural number equal to or greater than 2) unit interfaces (UIs) and comprise M (M being a natural number equal to or greater than 1) additional UIs, and the comparative indicator may be inserted into the additional UIs.

In the timing controller, the comparative indicator may comprise information indicating whether to include the first image data in the data packet or whether to transmit the first image data.

In another aspect, the present disclosure provides a display device comprising: a panel comprising a pixel; a source driver configured to receive image data and output a data voltage corresponding to the image data to the pixel; and a timing controller configured to transmit the image data to the source driver, wherein the timing controller compares the image data in a pixel unit and determines whether to transmit the image data, based on a result of the comparison, and the source driver comprises a buffer configured to output the data voltage by using a bias current, and changes the bias current or performs charge sharing, based on the result of the comparison.

In the display device, the timing controller may compare image data of a pixel of a current line with image data of a pixel of a preceding line, and not transmit the image data of the pixel of the current line when the image data of the pixel of the current line is determined to be identical to the image data of the pixel of the preceding line; and, when the image data of the pixel of the current line is determined to be identical to the image data of the pixel of the preceding line, the source driver may change the bias current and repeatedly output a data voltage corresponding to the image data of the pixel of the preceding line.

In the display device, the source driver may fixe the bias current to a minimum value or a predetermined value.

In the display device, the source driver may comprise a bias controlling unit configured to adjust the bias current and to supply the bias current to the buffer, and the bias controlling unit may select one of multiple currents as the bias current.

In the display device, the timing controller may include the image data in a data packet, transmit the image data through transmission of the data packet, generate a comparative indicator indicating a result of the comparison, and include the comparative indicator in the data packet; and the source driver may operate based on the comparative indicator.

In the display device, the source driver may comprise a bias controlling unit configured to adjust the bias current and to supply the bias current to the buffer, and the bias controlling unit may change the bias current, based on the comparative indicator.

In the display device, the source driver may comprise a latch configured to latch the image data of the pixel of the preceding line, and the latch may repeatedly output a data voltage corresponding to the image data of the pixel of the preceding line, based on the comparative indicator.

In the display device, the comparative indicator may comprise information on: non-transmission of the image data of the pixel of the current line; repeated output of the image data of the pixel of the preceding line; and change of the bias current.

In the display device, the data packet may comprise a region indicating a clock, and the comparative indicator may be included in the region indicating the clock or in a region preceding or following the region indicating the clock.

In the display device, the timing controller compares image data of a pixel of a preceding line with image data of a pixel of a current line, and transmits the image data of the pixel of the current line when the image data of the pixel of the current line is determined to be different from the image data of the pixel of the preceding line; and the source driver performs charge sharing when the image data of the pixel of the current line is determined to be different from the image data of the pixel of the preceding line.

In the display device, the timing controller includes the image data in a data packet, transmits the image data through transmission of the data packet, generates a CS (charge sharing) indicator indicating whether to perform the charge sharing, and includes the CS indicator in the data packet; and the source driver performs charge sharing based on the CS indicator.

In the display device, the source driver may perform charge sharing with respect to multiple buffers having identical polarity.

In still another aspect, the present disclosure provides a source driver comprising: a driving controlling unit configured to receive a first data packet and a second data packet, which comprise image data for two pixels disposed adjacent to each other in an identical line, respectively; and a buffer unit, which comprises positive buffers having a positive polarity and negative buffers having a negative polarity, and which is configured to operate the pixels, based on the image data, wherein the first data packet comprises a positive charge-sharing indicator indicating whether to perform charge sharing of the positive buffers, and the second data packet comprises a negative charge-sharing indicator indicating whether to perform charge sharing of the negative buffers.

Each of the two pixels may comprise multiple subpixels, a half of the subpixels included in the two pixels may be operated by the positive buffers, and a remaining half of the subpixels may be operated by the negative buffers.

Each of the first data packet and the second data packet may comprise a comparative indicator indicating whether to repeat image data of a preceding line for a current line.

Each of the first data packet and the second data packet may comprise a region indicating a clock; and the comparative indicator, the positive charge-sharing indicator, and the negative charge-sharing indicator may be inserted into the region indicating the clock or a region preceding or following the region indicating the clock.

As described above, according to the present embodiment, it is possible to reduce power consumption by a display device by reducing transmission transaction of the same image data.

According to the present embodiment, it is possible to reduce EMI due to unnecessary transmission transaction.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION

Figure 1:
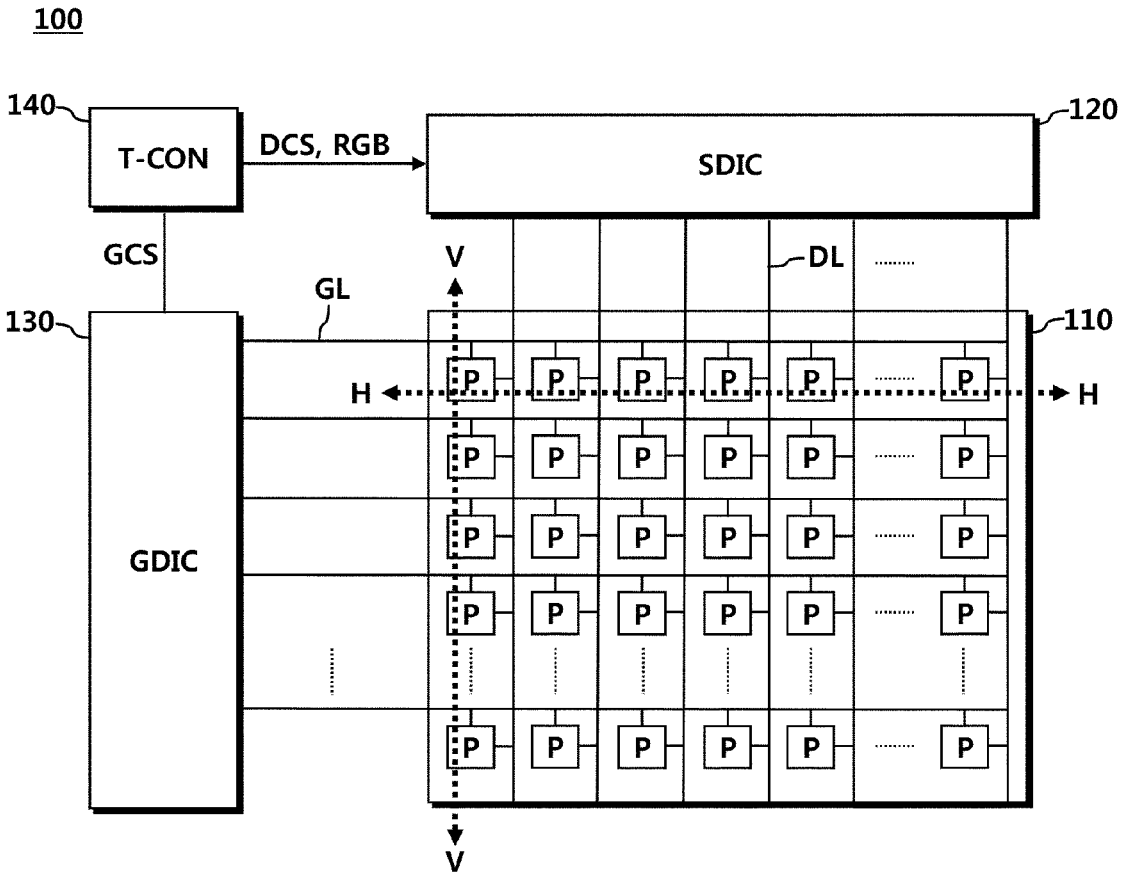
FIG. 1 illustrates the configuration of a display device according to one embodiment.

FIG. 1 illustrates the configuration of a display device according to one embodiment.

Referring to FIG. 1, a display 100 may include: a panel 110; a source driver 120; a gate driver 130; and a timing controller 140.

Multiple data lines (DLs), multiple gate lines (DL), and multiple pixels (Ps) may be arranged in the panel 110. The multiple pixels (Ps) may be disposed adjacent to each other in the horizontal direction (H) and the vertical direction (V) of the panel 110 so as to form a rectangular shape. The rectangular shape is similar to a matrix. Thus, a set of the multiple pixels (Ps) arranged in the horizontal direction (H) or a transverse line expressed thereby may be defined as a row or a line, and a set of the multiple pixels (Ps) arranged in the vertical direction (V) or a longitudinal line expressed thereby may be defined as a column.

The gate driver 130 may supply a scan signal of a turn-on voltage or a turn-off voltage to a gate line. When a scan signal of the turn-on voltage is supplied to a pixel (P), the corresponding pixel (P) is connected to a data line (DL), and, when a scan signal of the turn-off voltage is supplied to a pixel (P), the corresponding pixel (P) is disconnected from a data line (DL).

The source driver 120 supplies a data voltage to a data line (DL). The data voltage supplied to the data line (DL) is transferred to a pixel (P), connected to the data line (DL), according to a scan signal.

The timing controller 140 may supply various types of control signals to the gate driver 130 and the source driver 120. The timing controller 140 may generate a gate control signal (GCS) for starting a scan according to the timing implemented in each frame, and may transmit the generated gate control signal (CGS) to the gate driver 130. The timing controller 140 may output, to the source driver 120, image data (RGB) obtained by changing image data input from the outside in conformity with a data type used in the source driver 120. Further, the timing controller 140 may transmit a data control signal (DCS) that controls the source driver 120 to supply a data voltage to each pixel (P) in conformity with each timing.

Figure 2:
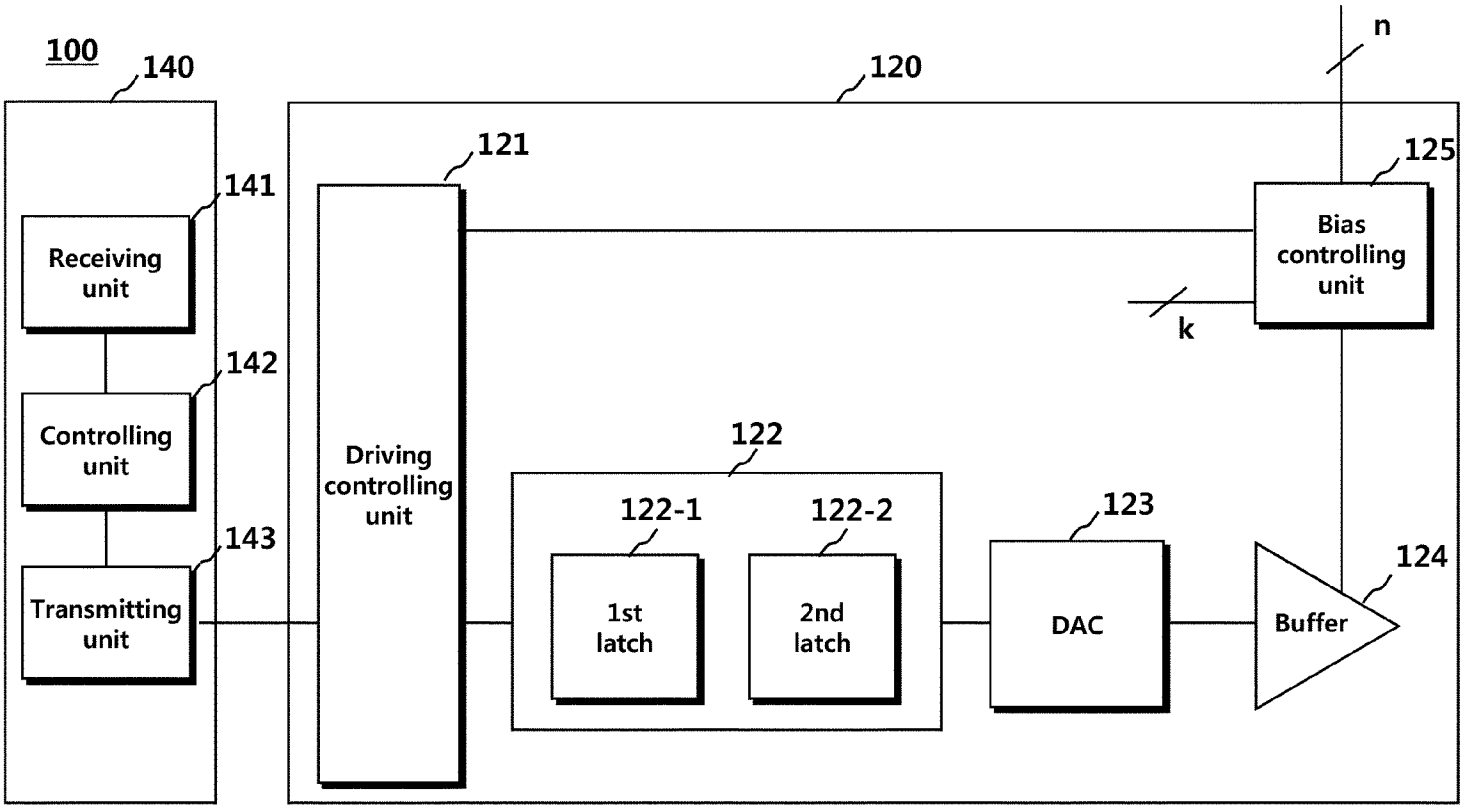
FIG. 2 illustrates configurations of a source driver and a timing controller according to one embodiment.

FIG. 2 illustrates configurations of a source driver and a timing controller according to one embodiment.

Referring to FIG. 2, the timing controller 140 may include a receiving unit 141, a controlling unit 142, and a transmitting unit 143.

The timing controller 140 may compare image data in units of pixels, and may determine, based on the comparison result, whether to transmit the image data. Comparing image data in units of pixels may be comparing image data of a current line pixel with image data of a preceding line pixel, wherein the current line pixel and the preceding line pixel are connected to the same channel.

As a result of the comparison, when the image data of the current line pixel is identical to the image data of the preceding line pixel, the timing controller 140 may not transmit the image data of the current line pixel. Alternatively, as a result of the comparison, when the image data of the current line pixel is different from the image data of the preceding line pixel, the timing controller 140 may transmit the image data of the current line pixel.

The receiving unit 141 may receive image data from the outside and may transfer the received image data to the controlling unit 142.

The controlling unit 142 may process the image data received from the receiving unit 141 in a form capable of being processed by the source driver 120, and may transmit the processed image data to the source driver 120 via the transmitting unit 143.

The controlling unit 142 may compare image data in units of pixels. The controlling unit 142 may compare image data of pixels of multiple adjacent lines among multiple pixels connected to one channel. Herein, the pixels of the multiple lines may be a pixel of a current line and a pixel of a preceding line. Each of the current line and the preceding line may be a single line or at least two lines.

For example, when the display device 100 operates a panel sequentially in line units from a first line to an Nth (N is a natural number) line, the controlling unit 142 may compare image data of a pixel of a first line of one channel with image data of a pixel of a second line of the one channel. The controlling unit 142 may also compare image data of a pixel of an (N−1)th line of the one channel with image data of a pixel of an Nth line of the one channel. The first and (N−1)th lines may be preceding lines, and the second and Nth lines may be current lines.

The controlling unit 142 may generate a data packet that includes information required to operate the source driver 120. The controlling unit 142 may include a clock, control data, and image data in the data packet, and may transmit the data packet to the source driver 120 via the transmitting unit 143. The controlling unit 142 may transmit various types of information such as control data and image data to the source driver 120 through the transmission of the data packet.

The controlling unit 142 may include the result of comparison between image data, performed in units of pixels, in the data packet. A comparative indicator indicating the comparison result may be included in one region of the data packet. The source driver 120 may recognize, based on the comparative indicator, whether image data of a current line is identical to image data of a preceding line. The source driver 120 may perform an operation corresponding to the comparative indicator.

When image data of a pixel of a current line is identical to image data of a pixel of a preceding line, the controlling unit 142 may not include the image data of the pixel of the current line in a data packet, and thus may not transmit the image data of the pixel of the current line to the source driver 120. Further, the controlling unit 142 may instruct the source driver 120 to fix a bias current of a buffer 124 to a minimum value or a predetermined value and thereby repeatedly output the image data of the pixel of the preceding line in the pixel of the current line. The controlling unit 142 may include information about the comparison and the instruction in a comparative indicator, and the source driver 120 may operate according to the comparative indicator.

When the image data of the pixel of the current line is different from the image data of the pixel of the preceding line, the controlling unit 142 may include the image data of the pixel of the current line in the data packet, thereby transmitting the image data of the pixel of the current line to the source driver 120. Further, the controlling unit 142 may instruct the source driver 120 to output the image data of the pixel of the current line. The controlling unit 142 may include information about the comparison and the instruction in the comparative indicator, and the source driver 120 may operate according to the comparative indicator.

When the image data of the current line is different from the image data of the preceding line, the controlling unit 142 may instruct the source driver 120 to perform charge sharing. Herein, the controlling unit 142 may calculate a gain with regard to power consumption and may determine, based on the gain, whether to perform charge sharing. When there is a gain, the controlling unit 142 may instruct the source driver 120 to perform charge sharing. When there is no gain, the controlling unit 142 may not instruct the source driver 120 to perform charge sharing. The controlling unit 142 may calculate the gain, based on a data voltage corresponding to the image data of the pixel of the preceding line, a data voltage corresponding to the image data of the pixel of the current line, and a voltage when charge sharing has been performed, i.e., a charge-sharing voltage.

The controlling unit 142 may include, in the data packet, information about whether to perform charge sharing. A charge-sharing indicator (CS indicator) indicating whether to perform the charge sharing may be included in one region of the data packet. The source driver 120 may recognize, through the CS indicator, whether to perform charge sharing. The source driver 120 may perform an operation corresponding to the CS indicator.

The transmitting unit 143 may receive a data packet from the controlling unit 142, and may transmit the received data packet to the source driver 120. The data packet may include a clock, image data, a comparative indicator, and a CS indicator.

The source driver 120 may include: a driving controlling unit 121, a latch 122, an analog/digital converter 123, a buffer 124, and a bias controlling unit 125.

The source driver 120 may change a bias current of the buffer 124 included therein or perform charge sharing, based on the result of comparison of image data of a pixel of a current line and image data of a pixel of a preceding line.

When the image data of the pixel of the current line is identical to the image data of the pixel of the preceding line, the source driver 120 may change the bias current of the buffer 124, and may repeatedly output a data voltage corresponding to the image data of the pixel of the preceding line. Alternatively, when the image data of the pixel of the current line is different from the image data of the pixel of the preceding line, the source driver 120 may perform charge sharing.

The driving controlling unit 121 may control the latch 122, the analog/digital converter 123, the buffer 124, and the bias controlling unit 125. The driving controlling unit 121 may receive, from the timing controller 140, a data packet which includes control data, image data, a comparative indicator, and a CS indicator. The driving controlling unit 121 may control the latch 122, the analog/digital converter 123, the buffer 124, and the bias controlling unit 125 based on the control data, the image data, the comparative indicator, and the CS indicator, which are included in the data packet.

When image data of a pixel of a current line is identical to image data of a pixel of a preceding line, the driving controlling unit 121 may not transmit the image data of the pixel of the current line to the latch 122. The driving controlling unit 121 may determine the identity using the comparative indicator of the data packet.

When the image data of the pixel of the current line is different from the image data of the pixel of the preceding line, the driving controlling unit 121 may perform charge sharing for a data voltage output by the buffer 124. The driving controlling unit 121 may determine the difference based on the comparative indicator of the data packet, and may determine whether to perform charge sharing, based on the CS indicator.

The latch 122 may latch image data, and may include a first latch 122-1 and a second latch 122-2. The latch 122 may receive image data transmitted from the driving controlling unit 121, and may transmit the received image data to the analog/digital converter 123.

When image data of a pixel of a current line is identical to image data of a pixel of a preceding line, the second latch 122-2 may output stored image data of the pixel of the preceding line again for the pixel of the current line. When the image data of the pixel of the current line is different from the image data of the pixel of the preceding line, the first latch 122-1 may receive the image data of the pixel of the current line and may transmit the received image data to the second latch 122-2. The second latch 122-2 may output the image data of the pixel of the current line.

The analog/digital converter 123 may convert image data into an analog signal (e.g., a data voltage).

The buffer 124 may operate a pixel by amplifying the analog signal (e.g., the data voltage) and apply the amplified analog signal to a data line.

The buffer 124 may output a data voltage by using a bias current. The bias current may be received from the bias controlling unit 125.

The bias controlling unit 125 may adjust a bias current of the buffer 124. When image data of a pixel of a current line is identical to image data of a pixel of a preceding line, the bias controlling unit 125 may fix a bias current to a minimum value or a specific value, and may supply the bias current having the fixed value to the buffer 124. The buffer 124 may again output a data voltage corresponding to the image data of the pixel of the preceding line for the pixel of the current line by using the bias current having the fixed value.

The bias controlling unit 125 may select one of multiple currents as a bias current. For example, the bias controlling unit 125 may receive n current signals and k selection signals from the outside. The selection signals may be generated by the driving controlling unit 121. The bias controlling unit 125 may select k current signals from among the n current signals through the selection signals, and may supply the selected current signals as bias currents to the buffer 124. Each of the selected current signals may have a minimum value or a specific value. Alternatively, the bias controlling unit 125 may control the amount of an external current to generate a bias current.

Figure 3:
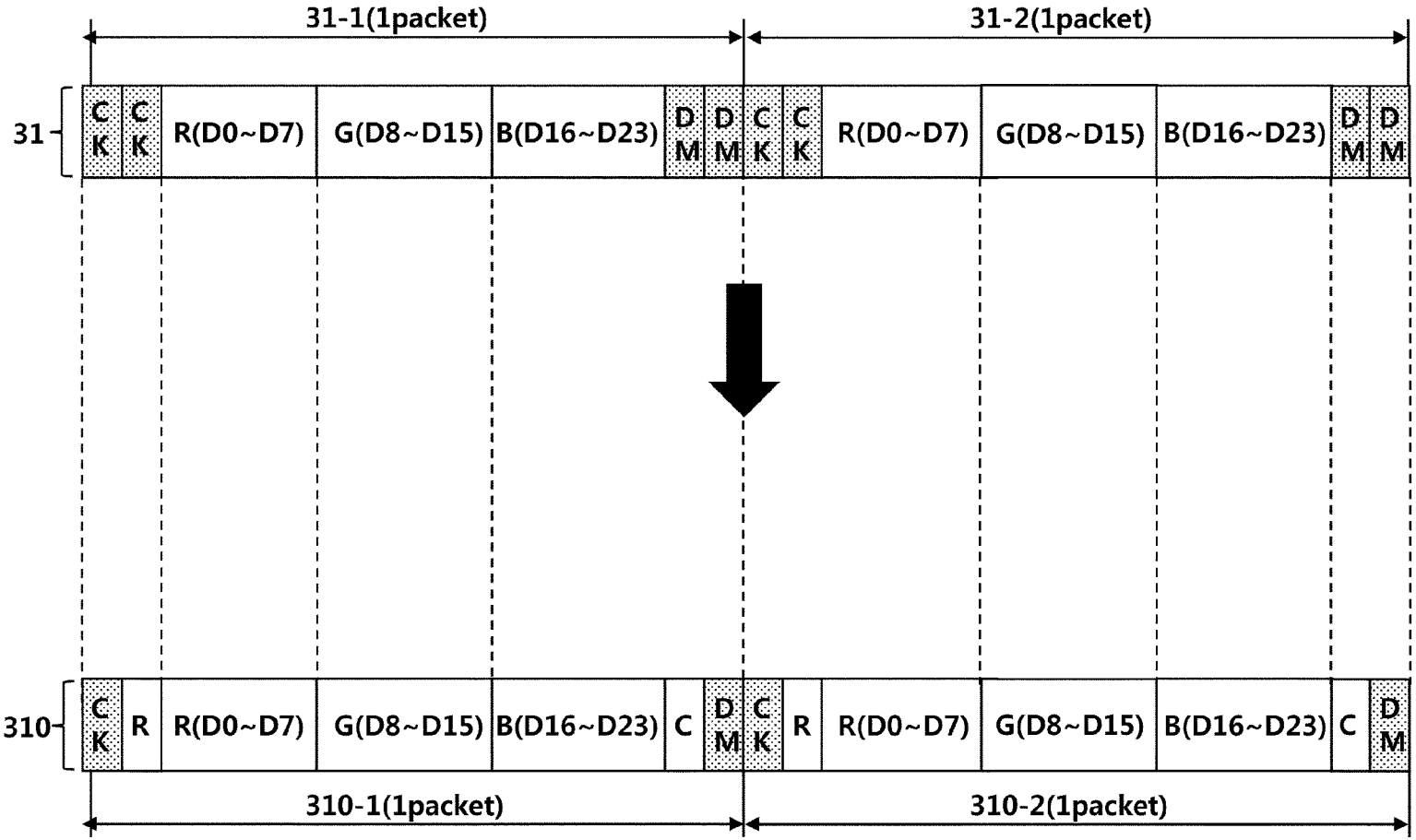
FIG. 3 illustrates a data packet according to one embodiment.

FIG. 3 illustrates a data packet according to one embodiment.

Referring to FIG. 3, a typical data packet 31 and a data packet 310 according to one embodiment are illustrated. Each of the data packets 31 and 310 may be transmitted from a timing controller to a source driver for each pixel. However, in the present drawing, two data packets for two pixels are illustrated is sequence.

The typical data packet 31 for a first pixel and a second pixel positioned adjacent and parallel to each other on one line may include a first data packet 31-1 and a second data packet 31-2. Each of the data packets 31-1 and 31-2 may include a first region, an image data region, and a second region. A clock may be embedded in the first region and/or the second region Image data may be included in the image data region. The second region may be an empty reserved space. Each of the data packets 31-1 and 31-2 may be represented by about 28 unit interfaces (28 UIs) or 28 bits, wherein the first region may occupy 2 UIs, the image data region may occupy 24 UIs, and the second region may occupy 2 UIs.

A clock may be inserted into a first UI of the first region and a second UI of the second region. A clock may be inserted into a first UI and a $28^{th}$ UI among a total of 28 UIs. The source driver may extract the clock by recognizing an edge between the $28^{th}$ UI and the first UI.

Multiple types of image data may be include in the image data region. The multiple types of image data may be provided for RGB subpixels. A pixel may include multiple subpixels (SPs). Herein, the subpixels may be a red (R) subpixel, a green (G) subpixel, a blue (B) subpixel, a white (W) subpixel, etc. One pixel may include RGB subpixels, RGBG subpixels, or RGBW subpixels. Hereinafter, for ease of description, a description will be made of the case in which one pixel includes RGB subpixels. In an image data region of one data packet, each of image data of an R subpixel, image data of a G subpixel, and image data of a B subpixel may occupy eight UIs.

The data packet 310 according to one embodiment may also include a first data packet 310-1 and a second data packet 310-2. However, each of the first data packet 310-1 and the second data packet 310-2 may include a comparative indicator R and a CS indicator (C), wherein the comparative indicator R is positioned in any one UI of a first region, and the CS indicator (C) is positioned in any one UI of a second region.

If the data packet 310 has a total of 28 UIs, a clock may be inserted into a first UI and a $28^{th}$ UI, the comparative indicator R may be inserted into a second UI, and the CS indicator (C) may be inserted into a $27^{th}$ UI.

Alternatively, the comparative indicator R may be included not in the first region of the data packet 310 but in the second region thereof.

Alternatively, the timing controller may increase the size of the data packet 310, and the comparative indicator R may be included in the increased region or an added UI. For example, when the data packet 310 is enlarged from 28 UIs to 29 UIs, the comparative indicator R may be positioned in an added UI.

Figure 4:
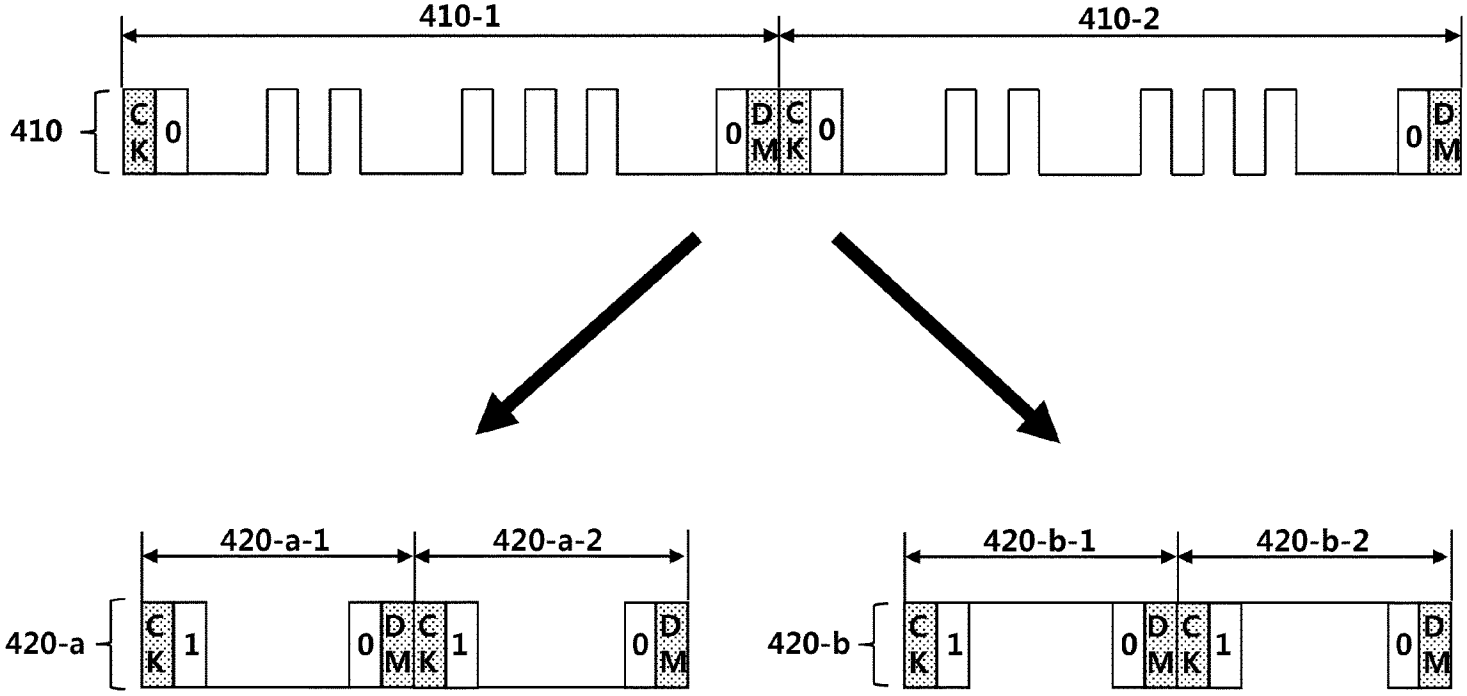
FIG. 4 illustrates a data packet when image data of a pixel of a current line is identical to image data of a pixel of a preceding line according to one embodiment.

FIG. 4 illustrates a data packet when image data of a pixel of a current line is identical to image data of a pixel of a preceding line according to one embodiment.

Referring to FIG. 4, as a result of comparing image data with each other in units of pixels, a data packet 410 of a pixel of a preceding line and data packets 420*a* and 420*b* of a pixel of a current line when the image data are identical to each other are respectively illustrated. In FIG. 4, each of the data packets 410, 420-*a*, and 420-*b* may be expressed by means of two adjacent pixel units in the same line. Hereinafter, it may be described that the data packets 410, 420-*a*, and 420-*b* include two respective sub-data-packets 410-1 and 410-2, 420-*a*-1 and 420-*a*-2, and 420-*b*-1 and 420-*b*-2.

When image data of a pixel of a current line is identical to image data of a pixel of a preceding line, a timing controller may generate the data packet 420-*a* of the pixel of the current line in a first example. The image data of the pixel of the current line is identical to the image data of the pixel of the preceding line, and thus a comparative indicator R may have a logic level of 1. Further, because the image data are identical to each other and thus there is no need to change a data voltage, a CS indicator (C) may have a logic level of 0. The comparative indicator R of 1 and the CS indicator (C) of 0 may be identically included in each of the sub-data-packets 420-*a*-1 and 420-*a*-2.

The data packet 420-*a* of the pixel of the current line may not include image data in an image data region. Since the image data of the pixel of the preceding line are already repeatedly output in the source driver, the data packet 420-*a* of the pixel of the current line need not include image data identical to the image data of the pixel of the preceding line. Instead, the data packet 420-*a* of the pixel of the current line may include predetermined data in the image data region. For example, the data packet 420-*a* of the pixel of the current line may include a specific value, and the image data region may be maintained at a low level. The low-level state may be identically maintained in the sub-data-packets 420-*b*-1 and 420-*b*-2.

Further, when image data of a pixel of a current line is identical to image data of a pixel of a preceding line, the timing controller may generate the data packet 420-*b* of the pixel of the current line in a second example. The image data of the pixel of the current line is identical to the image data of the pixel of the preceding line, and thus a comparative indicator R may have a logic level of 1. Further, because the image data are identical to each other and thus there is no need to change a data voltage, a CS indicator (C) may have a logic level of 0. The comparative indicator R of 1 and the CS indicator (C) of 0 may be identically included in each of the sub-data-packets 420-*a*-1 and 420-*a*-2.

Similarly, the data packet 420-*b* of the pixel of the current line may not include image data in an image data region. Since the image data of the pixel of the preceding line is already repeatedly output in the source driver, the data packet 420-*b* of the pixel of the current line need not include image data identical to the image data of the pixel of the preceding line. Instead, the data packet 420-*b* of the pixel of the current line may include predetermined data in the image data region. For example, the data packet 420-*b* of the pixel of the current line may include a specific value, and the image data region may be maintained at a high level. The high-level state may be identically maintained in the sub-data-packets 420-*b*-1 and 420-*b*-2.

Figures 5, 6:
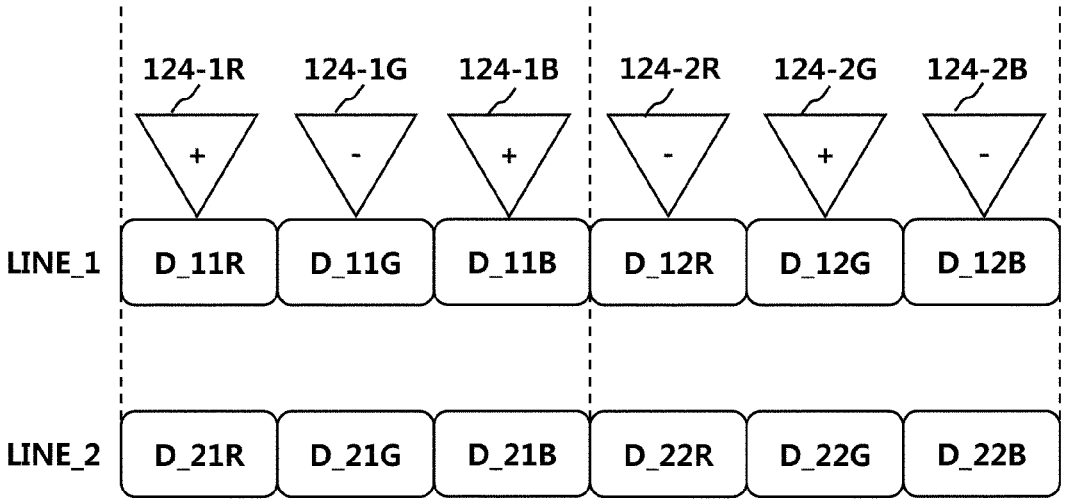
FIG. 5 is a view for describing a comparative indicator according to one embodiment.
FIG. 6 is a view in which buffers for outputting image data of a pixel of a current line, image data of a pixel of a preceding line, and data voltages for the image data are illustrated in units of subpixels according to one embodiment.

FIG. 5 is a view for describing a comparative indicator according to one embodiment.

Referring to FIG. 5, a source driver may operate according to a comparative indicator R. When a timing controller includes, in a comparative indicator R, information indicating that image data are identical to each other, the source driver may adjust a bias current for data voltage output, and may repeatedly output image data of a pixel of a preceding line to a pixel of a current line by using the adjusted bias current.

The comparative indicator R may include the above-described information. Specifically, the comparative indicator R may provide the source driver with the following information with respect to items such as image data transmission TX of the timing controller, a second latch ($2^{nd}$ latch) of the source driver, and a bias current of a buffer of the source driver.

That is, the comparative indicator R may provide the source driver with information indicating that image data transmission TX from the timing controller to the source driver does not occur (No transaction); the second latch ($2^{nd}$ latch) repeatedly outputs image data of a pixel of a preceding line to a pixel of a current line (Repeat) or the bias current of the buffer is adjusted to a minimum value or a specific value (Bias setting).

The comparative indicator R may provide information on reduction of power consumption by the timing controller and the source driver together. When the image data transmission TX from the timing controller to the source driver does not occur and image data of a pixel of a preceding line are repeatedly output to a pixel of a current line (No transaction/Repeat), the timing controller need not transmit image data, and thus power consumption can be reduced (TCON power low). Further, when the bias current (Bias) of the buffer is adjusted to a minimum value or a specific value (Bias setting), current consumption is reduced and thus power consumption can be reduced (SDIC power low).

FIG. 6 is a view in which buffers for outputting image data of a pixel of a current line, image data of a pixel of a preceding line, and data voltages for the image data are illustrated in units of subpixels according to one embodiment.

Referring to FIG. 6, a source driver may receive image data in units of subpixels, and may output a data voltage corresponding thereto. One pixel includes multiple subpixels, and thus a channel and a circuit module for operating the channel may be formed for each subpixel, and the channel may also be operated for each subpixel.

One pixel of one line may include an R subpixel, a G subpixel, and a B subpixel. Image data and a data voltage for the image data may be provided to each of the R subpixel, the G subpixel, and the B subpixel, and a buffer for outputting a data voltage may also be provided to each of the R subpixel, the G subpixel, and the B subpixel. Image data provided to an R subpixel may be defined as R image data, image data provided to a G subpixel may be defined as G image data, and image data provided to a B subpixel may be defined as B image data.

For example, when a first line LINE_1 is a preceding line and a second line LINE_2 is a current line, the source driver may include buffers 124-1R and 124-2R for operating R subpixels, buffers 124-1G and 124-2G for operating G subpixels, and buffers 124-1B and 124-2B for operating B subpixels. The buffer 124-1R may provide R image data D_11R to an R subpixel of one pixel of the first line, the buffer 124-1G may provide G image data D_11G to a G subpixel of the one pixel of the first line, and the buffer 124-1B may provide B image data D_11B to a B subpixel of the one pixel of the first line.

Further, the buffer 124-2R may provide R image data D_12R to an R subpixel of another pixel of the first line, the buffer 124-2G may provide G image data D_12G to a G subpixel of the another pixel of the first line, and the buffer 124-2B may provide B image data D_12B to a B subpixel of the another pixel of the first line.

Similarly, the buffers 124-1R, 124-1G, and 124-1B may provide R image data D_21R, G image data D_21G, and B image data D_21B to an R subpixel, a G subpixel, and a B subpixel of one pixel of the second line, respectively. The buffers 124-2R, 124-2G, and 124-2B may provide R image data D_22R, G image data D_22G, and B image data D_22B to an R subpixel, a G subpixel, and a B subpixel of another pixel of the second line, respectively.

Further, buffers for outputting data voltages to an R subpixel, a G subpixel, and a B subpixel may have different polarities. A buffer having a positive polarity may output a positive (+) data voltage, and a buffer having a negative polarity may output a negative (−) data voltage. The polarities of buffers may be alternately changed for each subpixel. For example, the positive buffers 124-1R, 124-1B, and 124-2G may output positive data voltages, and the negative buffers 124-1G, 124-2R, 124-2B may output negative data voltages.

Figure 7:
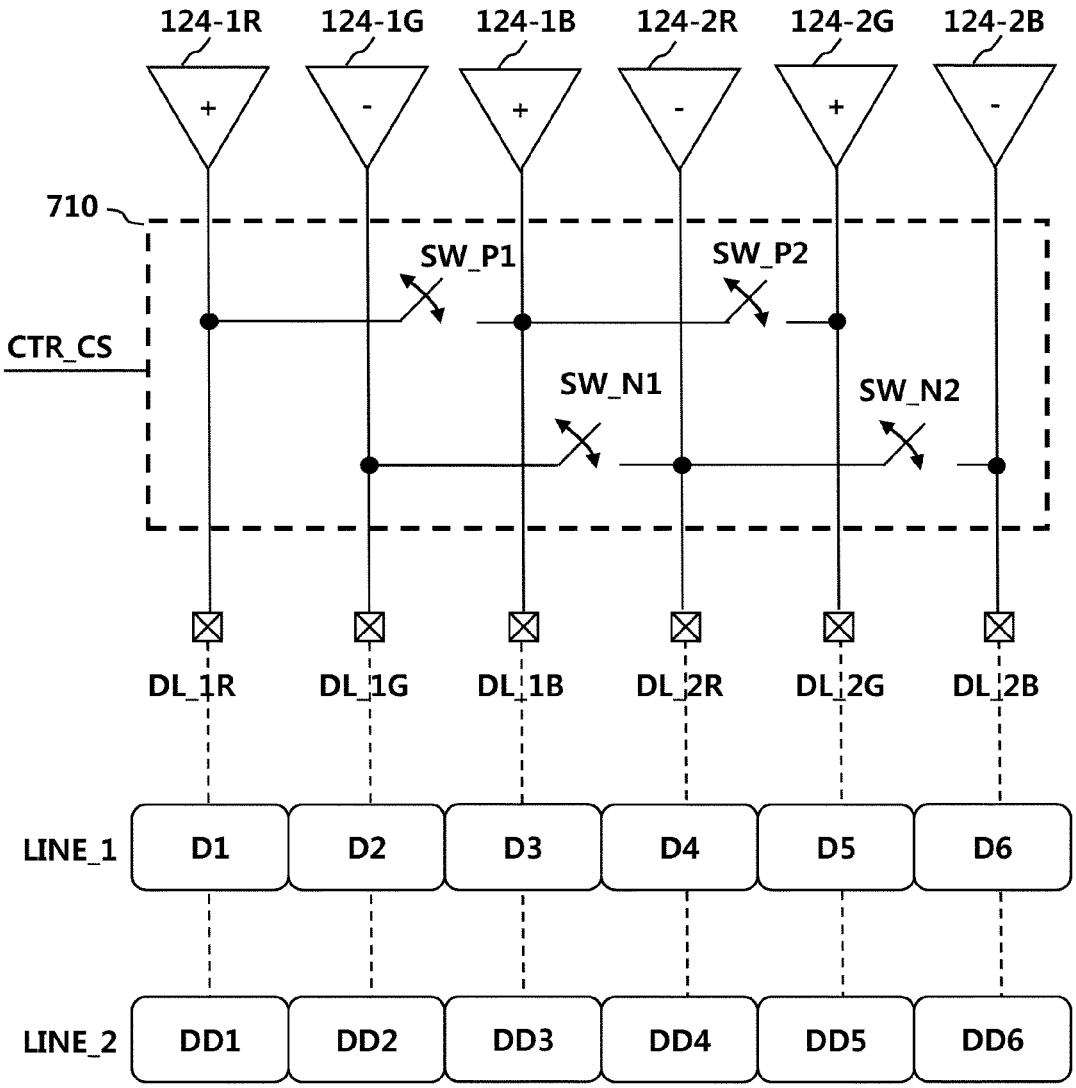
FIG. 7 is a view for describing a charge-sharing operation of a source driver according to one embodiment.

FIG. 7 is a view for describing a charge-sharing operation of a source driver according to one embodiment.

Referring to FIG. 7, the source driver may include a switching unit 710. The source driver may perform charge sharing through switching for connecting data lines to each other. The switching unit 710 may include multiple switches SW_P1, SW_P2, SW_N1, and SW_N2.

Buffers 124-1R, 124-1G, 124-1B, 124-2R, 124-2G, and 124-2B may be connected to data lines DL_1R, DL_1G, DL_1B, DL_2R, DL_2G, and DL_2B, respectively, so as to output data voltages to the data lines. A data voltage corresponding to R image data for R subpixels may be output to the data lines DL_1R and DL_2R, a data voltage corresponding to G image data for G subpixels may be output to the data lines DL_1G and DL_2G, and a data voltage corresponding to B image data for B subpixels may be output to the data lines DL_1B and DL_2B.

The switching unit 710 may perform charge sharing in response to a charge-sharing control signal CTR_CS. The charge-sharing control signal CTR_CS may be a signal for controlling a charge-sharing opertion of the switching unit 710. The charge-sharing control signal CTR_CS is at a high level, the switching unit 710 may perform charge sharing, and, when the charge-sharing control signal CTR_CS is at a lower level, the switching unit 710 may not perform charge sharing.

The charge-sharing control signal CTR_CS may be generated according a CS indicator included in a data packet. When the CS indicator includes information on performance of charge sharing, a driving controlling unit of the source driver, which has received the data packet, may generate a charge-sharing control signal CTR_CS for performing charge sharing. When the CS indicator includes information on nonperformance of charge sharing, the driving controlling unit of the source driver may generate a charge-sharing control signal CTR_CS for outputting a data voltage, without performing charge sharing.

Specifically, the switching unit 710 may receive outputs from the buffers 124-1R, 124-1G, 124-1B, 124-2R, 124-2G, and 124-2B, and, in response to the charge-sharing control signal CTR_CS, may share an electric charge by transferring a data voltage to the data lines DL_1R, DL_1G, DL_1B, DL_2R, DL_2G, and DL_2B or by connecting the data lines DL_1R, DL_1G, DL_1B, DL_2R, DL_2G, and DL_2B to each other. For example, when the charge-sharing control signal CTR_CS is at a high level, charge sharing may be performed by short-circuiting a first positive switch SW_P1 and a second positive switch SW_P2. When the charge-sharing control signal CTR_CS is at a low level, a first negative switch SW_N1 and a second negative switch SW_N2 are opened, and thus charge sharing is not performed and a data voltage may be output.

For electric charge sharing (i.e. charge sharing), the switching unit 710 may connect data lines of adjacent buffers having the same polarity to each other. For example, the positive switch SW_P1 may connect multiple data lines DL_1R and DL_1B to each other. The second positive switch SW_P2 may connect multiple data lines DL_1B and DL_2G to each other. The buffers 124-1R, 124-1B, and 124-2G for operating the data lines DL_1R, DL_1B, and DL_2G connected to each other may have a positive polarity. The first negative switch SW_N1 may connect multiple data lines DL_1G and DL_2R to each other. The second negative switch SW_N2 may connect multiple data lines DL_2R and DL_2B to each other. The buffers 124-1G, 124-2R, and 124-2B for operating the data lines DL_1G, DL_2R, and DL_2B connected to each other may have a negative polarity.

Charge sharing may be performed only when there is a gain with regard to power consumption. The gain may signify whether power consumption is reduced by performing charge sharing. The timing controller may calculate the gain. When there is a gain, the timing controller may reflect information on performance of charge sharing in a CS indicator, and may include the CS indicator in a data packet. When there is no gain, the timing controller may reflect information on nonperformance of charge sharing in a CS indicator and may include the CS indicator in a data packet.

The timing controller may calculate a gain, based on a data voltage for a pixel of a preceding line, a data voltage for a pixel of the current line, and a charge-sharing voltage for multiple pixels of the preceding line. Specifically, the timing controller may compare a first average value of data voltages when charge sharing is not performed with a second average value of the data voltages when charge sharing is performed. When the first average value is larger than the second average value, the timing controller may determine that there is a gain. When the first average value is not larger than the second average value, the timing controller may determine that there is no gain. Herein, a pixel may be a subpixel.

For example, when data voltages, which the buffer 124-1R, 124-1G, 124-1B, 124-2R, 124-2G, and 124-2B outputs to multiple subpixels of a first line LINE_1 serving as a preceding line are D1 to D6, and data voltages, which are output to multiple subpixels of a second line LINE_2 serving as a current line, are DD1 to DD6, a gain and a charge-sharing voltage for the positive buffers 124-1R, 124-1B, and 124-2G may be calculated using Equation 1 below.

$$(D1+D3+D5)/3=CS$$

$$|D1-DD1|+|D3-DD3|+|D5-DD5|=\text{AVG-NO-}CS$$

$$|CS-DD1|+|CS-DD3|+|CS-DD5|=\text{AVG-}CS \qquad \text{[Equation 1]}$$

Herein, CS is a charge-sharing voltage, AVG-NO-CS is a first average value of data voltages when charge sharing is not performed, and AVG-CS is a second average value of the data voltages when charge sharing is performed. The first average value (AVG-NO-CS) may be a value that is obtained by calculating absolute values for the differences between data voltages of multiple subpixels of a preceding line and data voltages of multiple subpixels of a current line and adding the absolute values together. The second average value (AVG-CS) may be a value that is obtained by calculating absolute values for the differences between a charge-sharing voltage and data voltages of the multiple subpixels of the current line and adding the absolute values together. Herein, the multiple subpixels may be subpixels that are operated by the positive buffers 124-1R, 124-1B, and 124-2G. When the first average value (AVG-NO-CS) is larger than the second average value (AVG-CS), the timing controller may include information on performance of charge sharing in a CS indicator.

Further, the gain and the charge-sharing voltage for the positive buffers 124-1R, 124-1B, and 124-2G may be calculated using Equation 2 below.

$$(D1+D3+D5)/3=CS$$

$$(DD1-D1)+(DD3-D3)+(DD5-D5|=\text{AVG-NO-}CS$$

$$(DD1-CS)+(DD3-CS)+(DD5-CS)=\text{AVG-}CS \qquad \text{[Equation 2]}$$

Herein, CS is a charge-sharing voltage, AVG-NO-CS is a first average value of data voltages when charge sharing is not performed, and AVG-CS is a second average value of the data voltages when charge sharing is performed. The first average value (AVG-NO-CS) may be a value that is obtained by summing up values for the differences between data voltages of multiple subpixels of a preceding line and data voltages of multiple subpixels of a current line. The second average value (AVG-CS) may be a value that is obtained by summing up values for the differences between a charge-sharing voltage and data voltages of the multiple subpixels of the current line. Herein, the multiple subpixels may be subpixels that are operated by the positive buffers 124-1R, 124-1B, and 124-2G. When the first average value (AVG-NO-CS) is larger than the second average value (AVG-CS), the timing controller may include information on performance of charge sharing in a CS indicator.

A gain and a charge-sharing voltage for the negative buffers 124-1G, 124-2R, and 124-2B may be calculated using Equation 3 below.

$$(D2+D4+D6)/3=CS$$

$$|D2-DD2|+|D4-DD4|+|D6-DD6|=\text{AVG-NO-}CS$$

$$|CS-DD2|+|CS-DD4|+|CS-DD6|=\text{AVG-}CS \qquad \text{[Equation 3]}$$

Herein, CS is a charge-sharing voltage, AVG-NO-CS is a first average value of data voltages when charge sharing is not performed, and AVG-CS is a second average value of the data voltages when charge sharing is performed. The first average value (AVG-NO-CS) may be a value that is obtained by calculating absolute values for the differences between data voltages of multiple subpixels of a preceding line and data voltages of multiple subpixels of a current line and adding the absolute values together. The second average value (AVG-CS) may be a value that is obtained by calculating absolute values for the differences between a charge-sharing voltage and data voltages of the multiple subpixels of the current line and adding the absolute values together. Herein, the multiple subpixels may be subpixels that are operated by the negative buffers 124-1G, 124-2R, and 124-2B. When the first average value (AVG-NO-CS) is larger than the second average value (AVG-CS), the timing controller may include information on performance of charge sharing in a CS indicator.

Further, the gain and the charge-sharing voltage for the negative buffers 124-1G, 124-2R, and 124-2B may be calculated using Equation 4 below.

$$(D2+D4+D6)/3=CS$$

$$(DD2-D2)+(DD4-D4)+(DD6-D6|=\text{AVG-NO-}CS$$

$$(DD2-CS)+(DD4-CS)+(DD6-CS)=\text{AVG-}CS \qquad \text{[Equation 4]}$$

Herein, CS is a charge-sharing voltage, AVG-NO-CS is a first average value of data voltages when charge sharing is not performed, and AVG-CS is a second average value of the data voltages when charge sharing is performed. The first average value (AVG-NO-CS) may be a value that is obtained by summing up values for the differences between data voltages of multiple subpixels of a preceding line and data voltages of multiple subpixels of a current line. The second average value (AVG-CS) may be a value that is obtained by summing up values for the differences between a charge-sharing voltage and data voltages of the multiple subpixels of the current line. Herein, the multiple subpixels may be subpixels that are operated by the negative buffers 124-1G, 124-2R, and 124-2B. When the first average value (AVG-NO-CS) is larger than the second average value (AVG-CS), the timing controller may include information on performance of charge sharing in a CS indicator.

Figure 8:
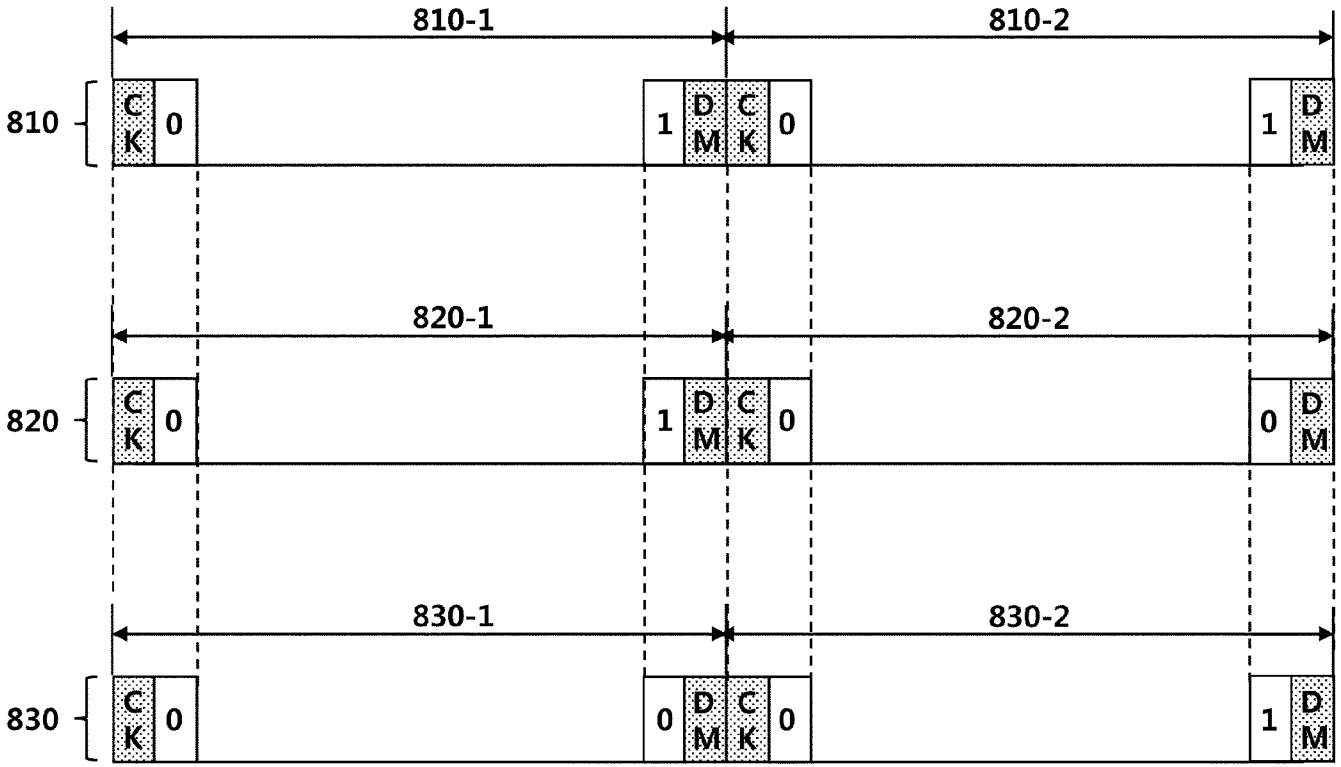
FIG. 8 illustrates a data packet including a CS indicator according to one embodiment.

FIG. 8 illustrates a data packet including a CS indicator according to one embodiment.

FIG. 8 illustrates an example of a data packet including information on performance of charge sharing and information on nonperformance of charge sharing. A data packet including a CS indicator may have various forms based on whether charge sharing is performed for a positive buffer or is performed for a negative buffer.

Data packets 810, 820, and 830 may include first data packets 810-1, 820-1, and 830-1 and second data packets 810-2, 820-2, and 830-2, respectively, wherein the first data packets and the second data packets include image data for two adjacent pixels of the same line, respectively. Each of the first data packets 810-1, 820-1, and 830-1 and the second data packets 810-2, 820-2, and 830-2 may carry image data for three subpixels—e.g. RGB subpixels—from the timing controller to the source driver. A CS indicator in each of the first data packets 810-1, 820-1, and 830-1 may indicate whether to perform charge sharing for a positive buffer, and a CS indicator in each of the second data packets 810-2, 820-2, and 830-2 may indicate whether to perform charge sharing for a negative buffer. The CS indicator may be positioned in one of two UIs in a second region.

When it is determined, based on a gain calculated by the timing controller, that both a positive buffer and a negative buffer require carrying out of charge sharing, a CS indicator in the first data packet 810-1 and a CS indicator in the second data packet 810-2 may have a logic level of 1.

When it is determined, based on a gain calculated by the timing controller, that the positive buffer requires carrying out of charge sharing, a CS indicator in the first data packet 820-1 may have a logic level of 1, and a CS indicator in the second data packet 820-2 may have a logic level of 0.

When it is determined, based on a gain calculated by the timing controller, that the negative buffer requires carrying out of charge sharing, a CS indicator in the first data packet 830-1 may have a logic level of 0, and a CS indicator in the second data packet 830-2 may have a logic level of 1.

Figure 9:
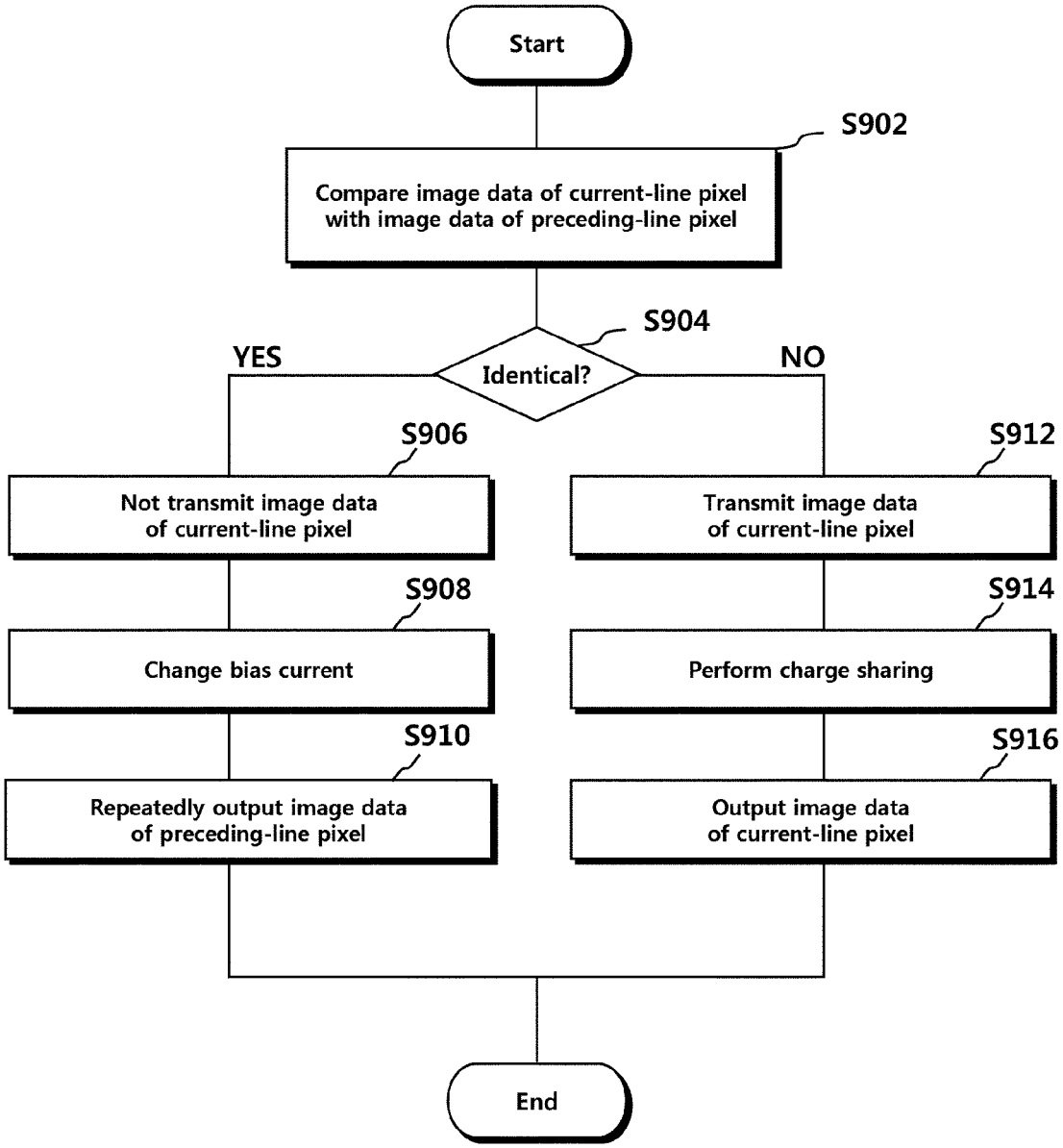
FIG. 9 is a flowchart illustrating operations of a display device according to one embodiment.

FIG. 9 is a flowchart illustrating operations of a display device according to one embodiment.

Referring to FIG. 9, a display device may compare image data of a pixel of a current line with image data of a pixel of a preceding line, and, based on the result of the comparison, may change a bias current of a data voltage output buffer or may perform charge sharing.

A timing controller may compare the image data of the pixel of the current line with the image data of the pixel of the preceding line (Step S902).

When the timing controller determines that the image data of the pixel of the current line is identical to the image data of the pixel of the preceding line (Yes in Step S904), the timing controller may not transmit the image data of the pixel of the current line to a source driver (Step S906). Herein, the timing controller may generate a data packet that does not include image data, may include a comparative indicator and a CS indicator in the data packet, and may then transmit the data packet.

When the source driver receives the data packet from the timing controller, the source driver may change the bias current of the data voltage output buffer to a minimum value or a specific value, based on the comparative indicator (Step S908).

The source driver may repeatedly output the image data of the pixel of the preceding line for the pixel of the current line (Step S910).

When the timing controller determines that the image data of the pixel of the current line is different from the image data of the pixel of the preceding line (No in Step S904), the timing controller may transmit the image data of the pixel of the current line to the source driver (Step S912). Herein, the timing controller may generate a data packet including the image data, may include a comparative indicator and a CS indicator in the data packet, and may then transmit the data packet.

The source driver may perform charge sharing based on the CS indicator (Step S914). However, when there is no gain to performing charge sharing, the source driver may not perform charge sharing, based on the CS indicator.

The source driver may output the image data of the pixel of the current line, received from the timing controller, for the pixel of the current line (Step S916).

What is claimed is:

1. A timing controller comprising:

a controlling unit configured to compare first image data of a pixel of a current line with second image data of a pixel of a preceding line, to determine whether to include the first image data in a data packet based on a result of the comparison, and to insert a comparative indicator indicating the result of the comparison into the data packet; and a transmitting unit configured to transmit the data packet to a source driver, wherein the transmitting unit does not transmit the first image data to the source driver when the first image data is identical to the second image data, and wherein the comparative indicator indicates whether to include the first image data in the data packet or whether to transmit the first image data.

2. The timing controller of claim 1, wherein the data packet comprises N (N being a natural number equal to or greater than 2) unit interfaces (UIs), a first UI and a Nth UI are used to extract a clock, and the comparative indicator is inserted into a second UI or a (N−1)th UI.

3. The timing controller of claim 1, wherein the data packet comprises N (N being a natural number equal to or greater than 2) unit interfaces (UIs) and comprises M (M being a natural number equal to or greater than 1) additional UIs, and the comparative indicator is inserted into one of the additional UIs.

4. A display device comprising:

a source driver configured to receive image data and output a data voltage corresponding to the image data to a pixel from pixels; and a timing controller configured to transmit the image data to the source driver, wherein the timing controller compares first image data of a pixel of a current line with second image data of a pixel of a preceding line, determines whether to include the first image data in a data packet based on a result of the comparison, and insert a comparative indicator indicating the result of the comparison into the data packet, and, wherein the timing controller does not transmit the first image data to the source driver when the first image data is identical to the second image data, and wherein the comparative indicator indicates whether to include the first image data in the data packet or whether to transmit the first image data.

5. The display device of claim 4, wherein the source driver comprises a buffer configured to output the data voltage using a bias current based on the result of the comparison, and wherein the source driver changes the bias current and repeatedly outputs a data voltage corresponding to the second image data of the pixel of the preceding line when the first image data is identical to the second image data.

6. The display device of claim 5, wherein the source driver fixes the bias current to a minimum value or a predetermined value.

7. The display device of claim 6, wherein the source driver comprises a bias controlling unit configured to adjust the bias current and to supply the bias current to the buffer, and the bias controlling unit selects one of multiple currents as the bias current.

8. The display device of claim 5, wherein the source driver operates based on the comparative indicator.

9. The display device of claim 8, wherein the source driver comprises a bias controlling unit configured to adjust the bias current and to supply the bias current to the buffer, and the bias controlling unit changes the bias current, based on the comparative indicator.

10. The display device of claim 8, wherein the source driver comprises a latch configured to latch the second image data of the pixel of the preceding line, and the latch repeatedly outputs a data voltage corresponding to the second image data of the pixel of the preceding line, based on the comparative indicator.

11. The display device of claim 8, wherein the comparative indicator comprises information on non-transmission of the first image data of the pixel of the current line, repeated output of the second image data of the pixel of the preceding line, and change of the bias current.

12. The display device of claim 8, wherein the data packet comprises a region indicating a clock, and the comparative indicator is included in the region indicating the clock or in a region preceding or following the region indicating the clock.

13. The display device of claim 4, wherein: the timing controller compares second image data of a pixel of a preceding line with first image data of a pixel of a current line, and transmits the first image data of the pixel of the current line when the first image data of the pixel of the current line is determined to be different from the second image data of the pixel of the preceding line; and the source driver performs charge sharing when the first image data of the pixel of the current line is determined to be different from the second image data of the pixel of the preceding line.

14. The display device of claim 13, wherein:

the timing controller includes the image data in a data packet, transmits the image data through transmission of the data packet, generates a CS (charge sharing)

indicator indicating whether to perform the charge sharing, and includes the CS indicator in the data packet; and the source driver performs charge sharing based on the CS indicator.

15. The display device of claim 13, wherein the source driver performs charge sharing with respect to multiple buffers having identical polarity.

* * * * *